US006629442B2

(12) United States Patent
Park

(10) Patent No.: US 6,629,442 B2
(45) Date of Patent: Oct. 7, 2003

(54) CUTTING BLADE BENDING APPARATUS CAPABLE OF PRECISELY FORMING ACUTE ANGLE

(76) Inventor: Hong-Soon Park, 433-13, Mangwon 2-dong, Mapo-ku, Seoul (KR), 121-232

( * ) Notice: Subject to any disclaimer, the term of this patent is extended or adjusted under 35 U.S.C. 154(b) by 0 days.

(21) Appl. No.: 09/997,708

(22) Filed: Nov. 29, 2001

(65) Prior Publication Data

US 2002/0066299 A1 Jun. 6, 2002

(30) Foreign Application Priority Data

Dec. 1, 2000 (KR) ..... 2000-72376

(51) Int. Cl.[7] ..... B21D 5/16; B21D 53/64
(52) U.S. Cl. ..... 72/307; 72/319
(58) Field of Search ..... 72/307, 306, 294, 72/388, 217, 214, 319

(56) References Cited

U.S. PATENT DOCUMENTS 3,742,749 A * 7/1973 Bondarenko et al. ..... 72/217
5,669,261 A * 9/1997 Castren ..... 72/307
5,787,750 A * 8/1998 Song ..... 72/307
5,881,591 A * 3/1999 Ondracek ..... 72/307
6,003,358 A * 12/1999 Lipari et al. ..... 72/307

FOREIGN PATENT DOCUMENTS

JP 62-181835 * 8/1987 ..... 72/319

* cited by examiner

*Primary Examiner*—Daniel C. Crane
(74) *Attorney, Agent, or Firm*—Gibbons, Del Deo, Dolan, Griffinger & Vecchione

(57) ABSTRACT

Disclosed is a cutting blade bending apparatus. The apparatus comprises a nozzle section for feeding a cutting blade into a bending area through a guide opening which is defined therein in a lengthwise direction of the cutting blade; a first bending member for bending the cutting blade fed into the bending area, in one direction; a second bending member for bending the cutting blade fed into the bending area, in the other direction; a first rotating body for firmly supporting the first bending member and guiding rotation of the second bending member; a second rotating body for firmly supporting the second bending member and guiding rotation of the first bending member, the second rotating body being rotated independent of the first rotating body; and a driving section for rotatably driving, at a time, one of the first and second rotating bodies.

13 Claims, 9 Drawing Sheets

CUTTING BLADE BENDING APPARATUS CAPABLE OF PRECISELY FORMING ACUTE ANGLE

BACKGROUND OF THE INVENTION

1. Field of the Invention

The present invention relates to a cutting blade bending apparatus, and more particularly, the present invention relates to a cutting blade bending apparatus capable of precisely forming an acute angle.

2. Description of the Related Art

Various cutting blade bending apparatuses have been disclosed in the art.

First, referring to FIG. 7*a,* there is shown a transverse cross-sectional view of a cutting blade bending apparatus as described in International Publication No. WO95/0026. In this cutting blade bending apparatus, as a cutting blade 100 is moved forward by rotation of rollers 92 and 93 while passing through a guide opening defined in a fixed die 70, the cutting blade 100 is bent by virtue of a movable die 71 which is rotatably arranged around the fixed die 70. That is to say, as the movable die 71 is rotated, distal ends 711, 711 of the movable die 71 bias sideward the cutting blade 100 which is securely grasped by distal ends 700, 700 of the fixed die 70, and thereby, the cutting blade 100 is bent leftward or rightward. However, this conventional cutting blade bending apparatus is encountered with a problem in that an acute angle to which the cutting blade 100 can be bent, is limited to a certain value. Concretely speaking, when assuming that the cutting blade 100 is bent rightward to a great extent so as to finally form an acute angle with respect to a reference line, as the bent portion of the cutting blade 100 is brought into contact with the fixed die 70, the cutting blade 100 cannot be bent anymore, and it becomes difficult for the movable die 71 to apply strong biasing force to the cutting blade 100.

To cope with this problem, a cutting blade bending system as shown in FIG. 7*b* is described in U.S. Pat. No. 5,870,919. This system is different from the conventional cutting blade bending apparatus described above, in that a movable die can be positioned in front of a fixed die to allow bending members 80 to be freely moved and each bending member 80 of the movable die has a pin-shaped configuration. In this system, two bending members 80 are employed to respectively bend a cutting blade leftward and rightward. When a left bending member 80 biases a cutting blade rightward, a right bending member 80 is retracted into a rotating body 81 so as not to stand in the way of a bent portion of the cutting blade. However, the cutting blade bending system suffers from defects in that, when the cutting blade is bent rightward by the left bending member 80 to form an acute angle. If the right bending member 80 is extended to bend the cutting blade leftward in a state wherein the cutting blade is already bent beyond a position of the right bending member 80, the right bending member 80 cannot but be idly rotated. It is impossible to bend the cutting blade leftward. Such causes interruption of the entire system. Therefore, it is impossible to form an acute angle which is less than a predetermined degree.

Moreover, the bending members 80 are worn out due to repetitive retraction and extension, and a gap cannot but be created between the bending members 80 and edges of the rotating body 81. The edges define openings for guiding the retraction and extension of the bending members 80. Accordingly, when actually bending the cutting blade, the bending members 80 are not firmly supported by the rotating body 81, thus horizontal and vertical bending accuracies for the cutting blade cannot but be deteriorated.

A typical apparatus which employs only one bending member, is disclosed in U.S. Pat. No. 6,145,359 filed in the name of the present applicant. In this apparatus, after the bending member bend a metal plate in a clockwise direction, if it is necessary to bend the metal plate in counterclockwise direction, the bending member is retracted into a rotating body. The rotating body is further rotated in the clockwise direction to a position where the bending member can abut the other side of the metal plate and then the bending member is extended out of the rotating body. However, the apparatus still suffers from a drawback in that, since the rotating body must be rotated through a large angle in the clockwise direction to bend the metal plate counterclockwise, it is difficult to secure a wide area that provides a position between a guide section and the bent portion of the metal plate. Because of this, a controlling of the apparatus becomes complicated.

Further, this single-pin type apparatus is superior, in view of its acute angle forming capability to bend rule over a wider angle, over the aforementioned two-pin type cutting blade bending apparatuses, because one single bending number should sequentially bend the metal plate in the one and the other directions. However, it is not superior over the two-pin type cutting blade bending apparatuses in view of operational rapidity.

SUMMARY OF THE INVENTION

Accordingly, the present invention has been made in an effort to solve the problems occurring in the related art. One aspect provides for a cutting blade bending apparatus that is capable of precisely forming an acute angle of a cutting blade and is excellent in view of operational rapidity and efficiency.

Another aspect provides a cutting blade bending apparatus which allows a cutting blade to be bent in a state wherein bending members are firmly supported by rotating bodies, thereby increasing horizontal and vertical bending accuracies for the cutting blade.

A further aspect provides a cutting blade bending apparatus comprising: a nozzle section for feeding a cutting blade into a bending area through a guide opening which is defined therein in a lengthwise direction of the cutting blade; a first bending member for bending the cutting blade fed into the bending area, in one direction; a second bending member for bending the cutting blade fed into the bending area, in the other direction; a first rotating body for firmly supporting the first bending member and guiding rotation of the second bending member; a second rotating body for firmly supporting the second bending member and guiding rotation of the first bending member, the second rotating body being rotated independent of the first rotating body; and a driving section for rotatably driving, at a time, one of the first and second rotating bodies.

By this feature of the present invention, the first bending member functions to bend the cutting blade in one direction, and the second bending member functions to bend the cutting blade in the other direction. Due to the fact that the first and second bending members are supported by the first and second rotating bodies, respectively, which are independently rotated of each other, rotating motion of the first bending member by the first rotating body and rotating motion of the second bending member by the second rotating body are independently implemented of each other. In the conventional art, since two bending members are supported by a common rotating body, a rotating angle of one bending member cannot but be restricted by the presence of the other bending member, whereby an acute angle cannot be adequately formed.

Also, in the present invention, because vertical movement of the first and second bending members as is the case with the conventional art, is unnecessary. Instead, the first and second bending members are rotated to bias the cutting blade while being firmly supported by the first and second rotating bodies. As a result, increased horizontal and vertical bending accuracies for the cutting blade can be accomplished, and operational rapidity can be ameliorated.

According to another aspect of the present invention, the nozzle section and the first and second rotating bodies are coaxially arranged one with another in a vertical direction, and the nozzle section passes through center portions of the first and second rotating bodies; the first rotating body comprises at least one pair of upper and lower rotating parts which are opposite to each other in the vertical direction with the guide opening of the nozzle section positioned between the upper and lower rotating parts and which are respectively defined with locking holes for firmly locking both ends of the first bending member and curved guide slots for guiding rotation of the second bending member; and the second rotating body comprises at least one pair of upper and lower rotating parts which are opposite to each other in the vertical direction with the guide opening of the nozzle section positioned between the upper and lower rotating parts and which are respectively defined with locking holes for firmly locking both ends of the second bending member and curved guide slots for guiding rotation of the first bending member.

By this feature of the present invention, the first rotating body comprises at least one pair of rotating parts which are separately positioned up and down. The second rotating body is configured in the same manner as the first rotating body. The first and second rotating bodies firmly support the first and second bending members, respectively. The first and second rotating bodies are defined with the curved guide slots for guiding rotation of the second and first bending members, respectively. The first and second rotating bodies and the nozzle section are concentrically arranged one with another. Accordingly, the first bending member which is firmly supported by the first rotating body, bends the cutting blade in one direction while being rotated along the curved guide slots defined in the second rotating body.

The second bending member which is firmly supported by the second rotating body, bends the cutting blade in the other direction while being rotated along the curved guide slots defined in the first rotating body. That is to say, a rotation angle of the second bending member is limited by the curved guide slots of the first bending member, and a rotation angle of the first bending member is limited by the curved guide slots of the second bending member.

In other words, the first rotating body provides the curved guide slots for guiding rotation of the second bending member which is not supported by it. This is of course, independent, in principle and time, of rotating motion of the first bending member which is actually supported by the first rotating body.

According to still another aspect of the present invention, each of the curved guide slots which are defined in the upper and lower rotating parts of the first rotating body, has one end corresponding to a bending standby position of the second bending member and the other end corresponding to a maximum bending position of the second bending member; and each of the curved guide slots which are defined in the upper and lower rotating parts of the second rotating body, has one end corresponding to a bending standby position of the first bending member and the other end corresponding to a maximum bending position of the first bending member.

By this feature of the present invention, in the cutting blade bending apparatus, after bending of the cutting blade in one direction is completed, the first bending member is returned to its bending standby position which is in the vicinity of a rear end of the nozzle section. At the same time, the second bending member which is in the bending standby position, can be rotated to bend the cutting blade in the other direction.

Also, as a matter of course, final rotation angles of the first and second bending members define the minimum acute angles which can be formed during the bending operation. Hence, the curved guide slots of the second rotating body for guiding rotation of the first bending member and the curved guide slots of the first rotating body for guiding rotation of the second bending member must be defined in a manner such that each curved guide slot has one end corresponding to the bending standby position and the other end corresponding to the maximum bending position (that is, a minimum acute angle forming position). In the present invention, the curved guide slots of the first and second bending members are symmetrically defined with each other.

According to yet still another aspect of the present invention, each of the first and second rotating bodies comprises at least two pairs of upper and lower rotating parts; upper rotating parts of the first and second rotating bodies are coaxially and alternately arranged one with another above the guide opening of the nozzle section; and lower rotating parts of the first and second rotating bodies are coaxially and alternately arranged one with another below the guide opening of the nozzle section.

By this feature of the present invention, since each of the first and second rotating bodies comprises at least two pairs of upper and lower rotating parts, and the rotating parts of the first and second rotating bodies are alternately arranged one with another, the bending members can apply stronger and uniform biasing force to the cutting blade, and thereby, precise vertical and horizontal bending of the cutting blade can be facilitated.

BRIEF DESCRIPTION OF THE DRAWINGS

The above aspects, and other features and advantages of the present invention will become more apparent after a reading of the following detailed description when taken in conjunction with the drawings, in which:

FIGS. 4A, 4B, 4C, 4D, 4E and 4F are perspective views and plan views for explaining a bending principle of the present invention in obedience to operating sequence, wherein FIGS. 4A and 4D illustrate a bending standby position, FIGS. 4B and 4E illustrate a bending start position and FIGS. 4C and 4F illustrate a minimum acute angle forming position;

DETAILED DESCRIPTION OF PREFERRED EMBODIMENTS

Figure 1:
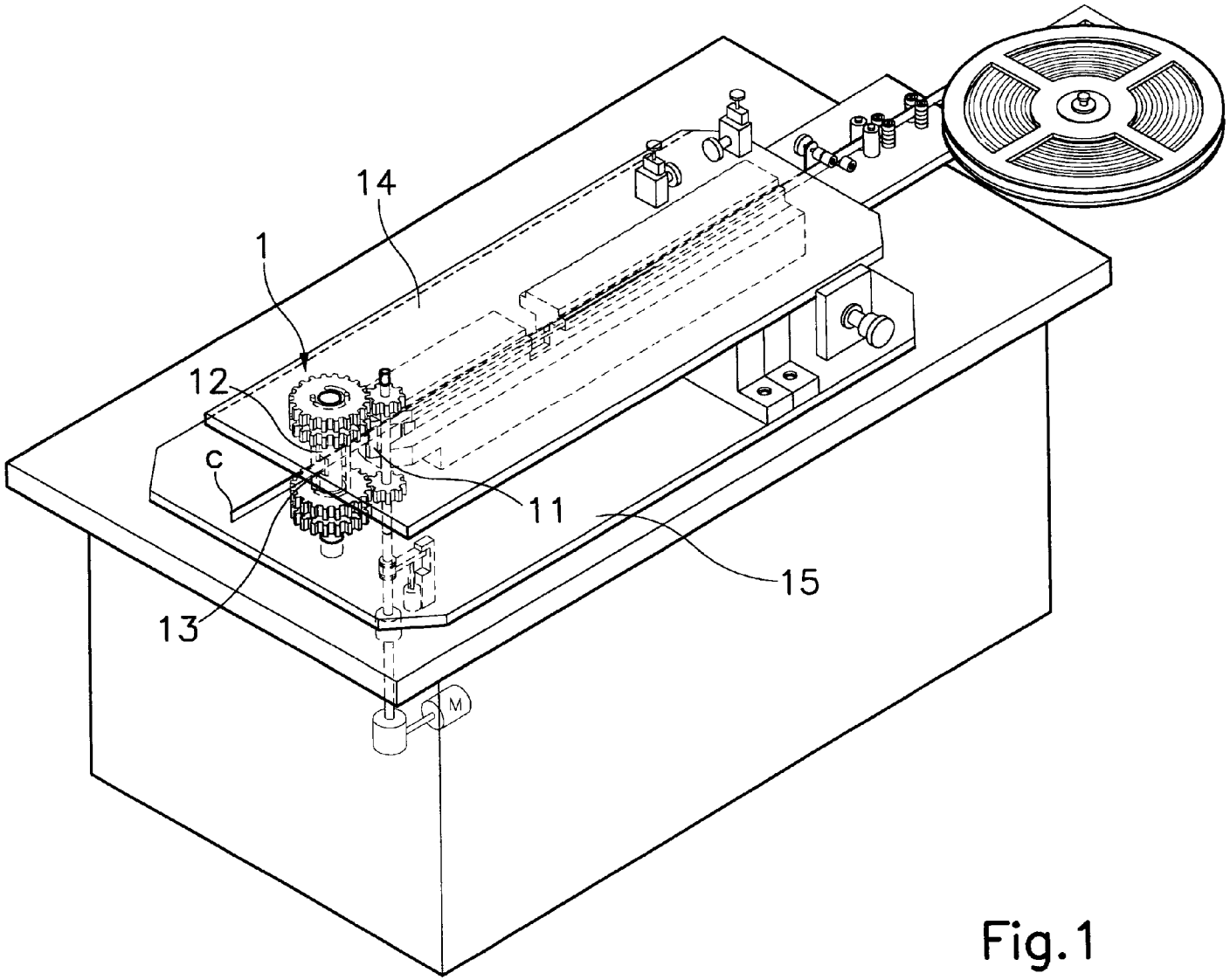
FIG. 1 is a perspective view schematically illustrating an entire construction of a bending system which includes a bending apparatus of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Referring to FIG. 1, there is shown a perspective view schematically illustrating an entire construction of a bending system which includes a bending apparatus 1 of the present invention. The entire bending system according to the present invention is constructed in the same manner as that described in U.S. Pat. No. 6,145,359 filed in the name of the present applicant, except the bending apparatus 1 which is disposed at the front part of the bending system. A nozzle section 12 for feeding forward a cutting blade C into a bending area is installed in front of a guide section 11. The nozzle section 12 feeds the cutting blade C which has passed through the guide section 11, into the bending area through a guide opening 13 which is defined therein in a lengthwise direction of the cutting blade C.

Figure 2:
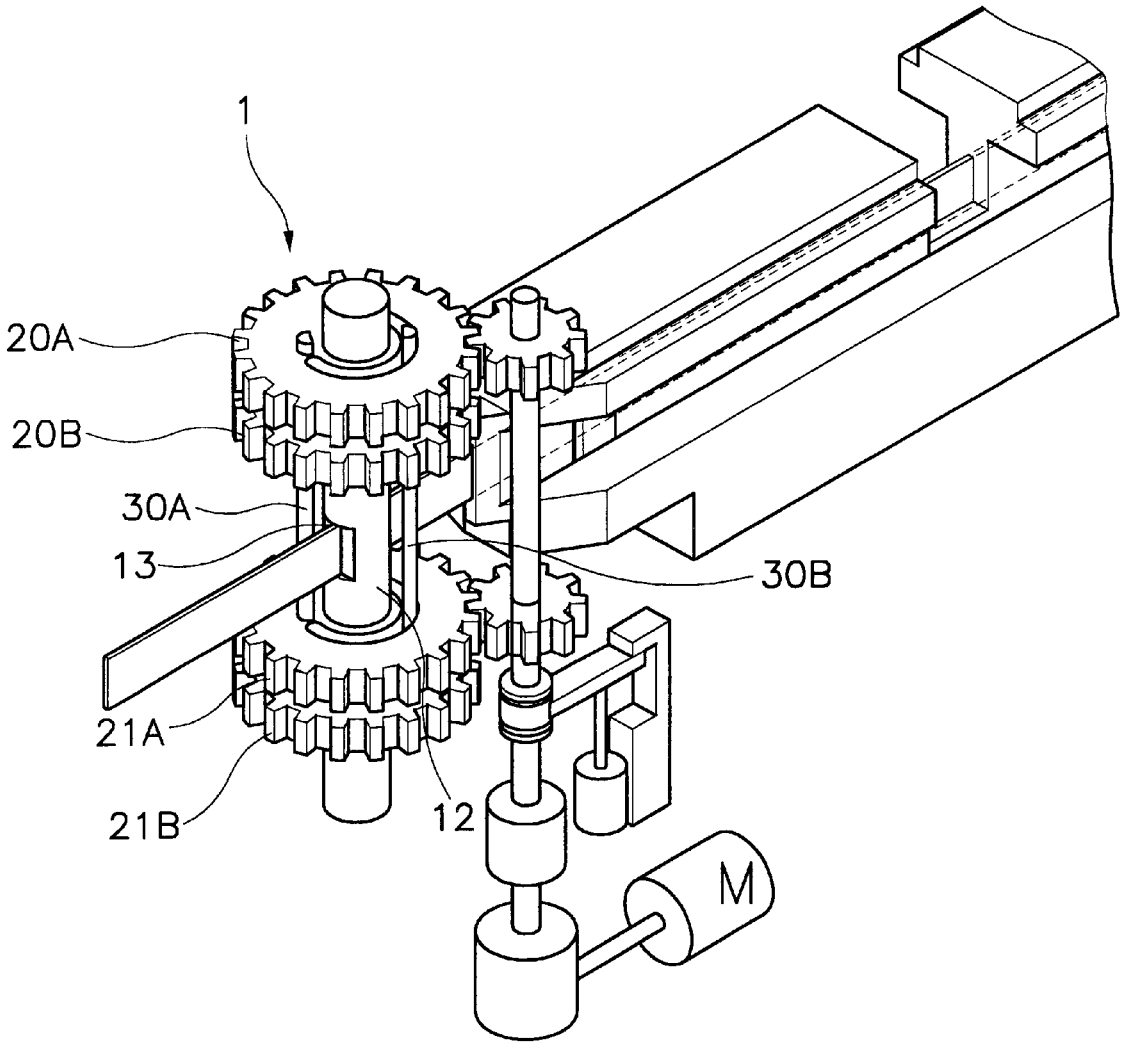
FIG. 2 is a partial, enlarged and broken-away perspective view illustrating a main part of the bending apparatus of the present invention.

Referring to FIG. 2, there are illustrated in detail the nozzle section, first and second rotating bodies, and first and second bending members respectively supported by the first and second rotating bodies, which comprise the bending apparatus of the present invention. An upper rotating part 20A of the first rotating body which forms a characterizing feature of the present invention, is arranged above the guide opening 13 of the nozzle section 12, and a lower rotating part 21A of the first rotating body is arranged below the guide opening 13 of the nozzle section 12. Also, an upper rotating part 20B of the second rotating body which forms the characterizing feature of the present invention, is arranged in such a way as to be brought into close contact with the upper rotating part 20A of the first rotating body, and a lower rotating part 21B of the second rotating body is arranged in such a way as to be brought into close contact with the lower rotating part 21A of the first rotating body.

The nozzle section 12, the upper and lower rotating parts 20A and 21A of the first rotating body, and the upper and lower rotating parts 20B and 21B of the second rotating body are concentrically and coaxially arranged one with another.

The nozzle section 12 passes through holes defined in center portions of the upper and lower rotating parts 20A and 21A of the first rotating body and holes defined in center portions of the upper and lower rotating parts 20B and 21B of the second rotating body. Both ends of the nozzle section 12 are securely locked to upper and lower plates 14 and 15 of the bending apparatus, preferably by brackets (not shown). As shown in FIG. 2, by concavely forming a front portion of the nozzle section 12 around the guide opening 13 through which the cutting blade C passes, an advantage is provided in that it is possible to secure a marginal space upon bending the cutting blade C.

Figure 3:
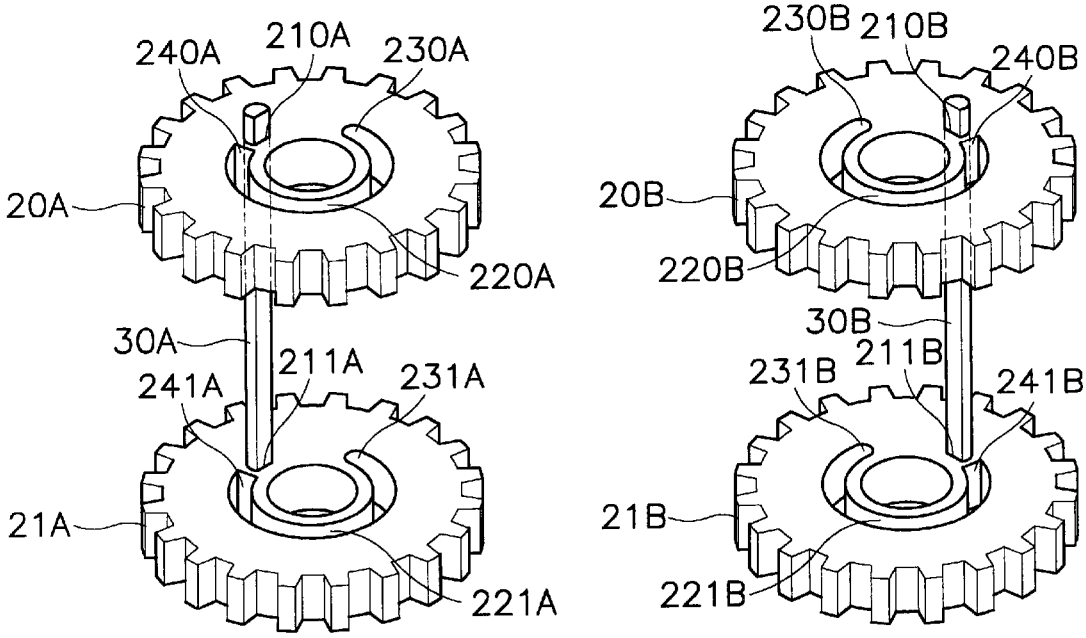
FIG. 3 is of perspective views respectively illustrating configurations of rotating bodies and bending members.

Configurations of the first and second rotating bodies and the first and second bending members according to the present invention will be described with reference to FIG. 3. While the first and second rotating bodies are illustrated in FIG. 3 in a disassembled status, they are actually assembled with each other as shown in FIG. 2 so that the upper and lower rotating parts of them are alternately arranged in the order of 20A, 20B, 21A and 21B in a vertical direction.

The upper and lower rotating parts 20A and 21A of the first rotating body are fabricated to have the same shape. The upper and lower rotating parts 20A and 21A of the first rotating body are defined with locking holes 210A and 211A for firmly supporting the first bending member 30A and curved guide slots 220A and 221A for guiding rotating motion of the second bending member 30B, respectively. One pair of ends 230A and 231A of the curved guide slots 220A and 221A provide a bending standby position of the second bending member 30B, and the other pair of ends 240A and 241A of the curved guide slots 220A and 221A provide a maximum rotation angle position of the second bending member 30B, that is, a minimum acute angle forming position for the cutting blade C.

The upper and lower rotating parts 20B and 21B of the second rotating body are also fabricated to have the same shapes. The upper and lower rotating parts 20B and 21B of the second rotating body are defined with locking holes 210B and 211B for firmly supporting the second bending member 30B and curved guide slots 220B and 221B for guiding rotating motion of the first bending member 30A, respectively.

The locking holes 210B and 211B of the second rotating bodies 20B and 21B are each formed at positions corresponding to the ends 230A and 231A of the first rotating bodies 20A and 21A, and the curved guide slots 220B and 221B extend from the positions adjacent to the locking holes 210B and 211B to the positions corresponding to the locking holes 210A and 211A of the first rotating bodies 20A and 21A so as to naturally form lengthy and circularly curved guide slots the same as those of the curved guide slots 220A and 221A.

One pair of ends 230B and 231B of the curved guide slots 220B and 221B provide a bending standby position of the first bending member 30A, and the other pair of ends 240B and 241B of the curved guide slots 220B and 221B provide a maximum rotation angle position of the first bending member 30A, that is, a minimum acute angle forming position for the cutting blade C.

While the first bending member 30A is supported by the upper and lower rotating parts 20A and 21A of the first rotating body, its range of rotation angle is defined by the curved guide slots 220B and 221B which are respectively defined in the upper and lower rotating parts 20B and 21B of the second rotating body. Further, while the second bending member 30B is supported by the upper and lower rotating parts 20B and 21B of the second rotating body, its range of rotation angle is defined by the curved guide slots 220A and 221A which are respectively defined in the upper and lower rotating parts 20A and 21A of the first rotating body. When the upper and lower rotating parts 20A and 21A of the first rotating body are rotated, the upper and lower rotating parts 20B and 21B of the second rotating body are fixedly maintained, and, when the upper and lower rotating parts 20B and 21B of the second rotating body are rotated, the upper and lower rotating parts 20A and 21A of the first rotating body are fixedly maintained. Consequently, rotation of the first and second bending members 30A and 30B is independently implemented.

In the above descriptions, if it is necessary to bend the cutting blade C in such a way as to form a small acute angle, by further extending the other pair of ends 240A, 241A, 240B and 241B of the curved guide slots 220A, 221A, 220B and 221B, rotation angle ranges of the first and second bending members 30A and 30B can be widened. In addition, as described above, by concavely forming the front portion of the nozzle section 12 around the guide opening 13 through which the cutting blade C passes, it is possible to prevent a portion of the cutting blade C which is bent to form an angle, from being brought into contact with the nozzle section 12, whereby a disadvantage which may be induced by interruption of a bending operation, can be avoided. A person skilled in the art will readily recognize that positions of the locking holes and the curved guide slots in FIG. 3 can be freely altered without departing from a technical spirit of the present invention. For example, the locking holes 210A and 211A of the upper and lower rotating parts 20A and 21A of the first rotating body can be defined adjoining the one pair of ends 230A and 231A of the curved guide slots 220A and 221A. In this case, it is to be readily understood that the locking holes 210B and 211B of the upper and lower rotating parts 20B and 21B of the second rotating body must be also defined adjoining the one pair of ends 230B and 231B of the curved guide slots 220B and 221B.

Figure 4C:
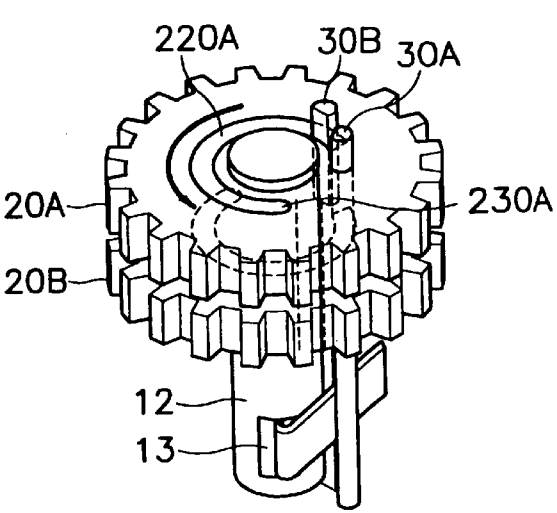
Figure 4F:
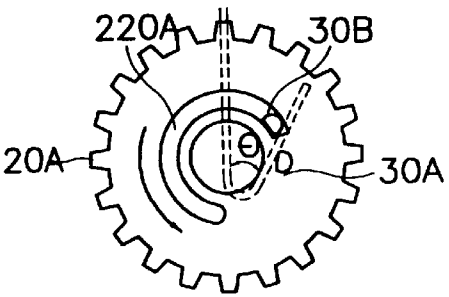
Figure 4B:
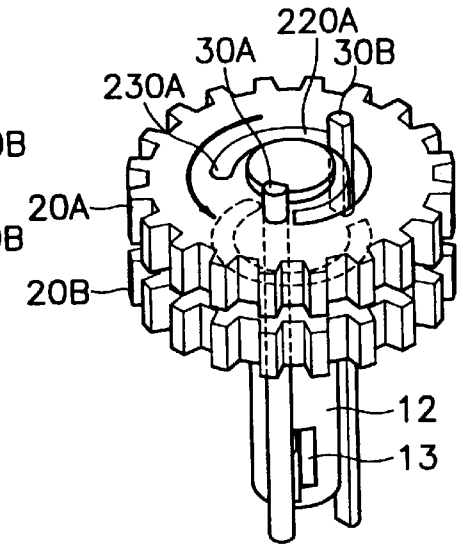
Figure 4E:
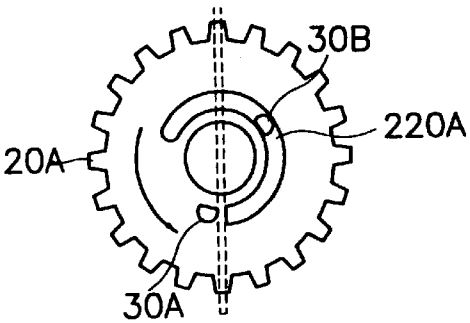
Figure 4A:
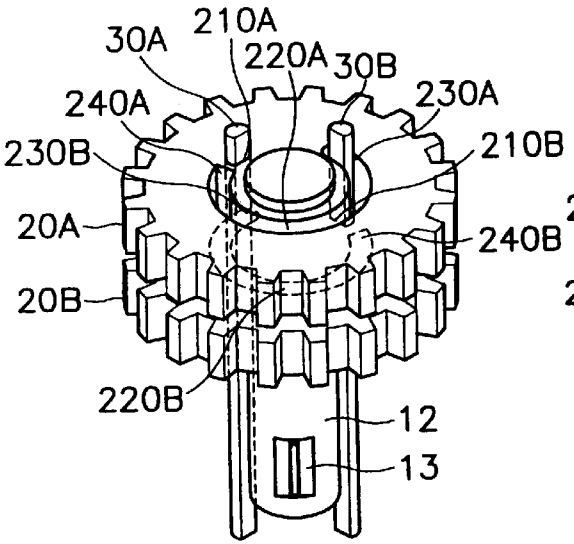
Figure 4D:
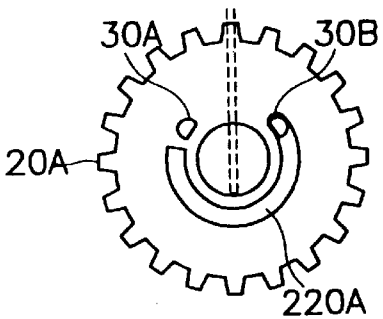

FIGS. 4A, 4B, 4C, 4D, 4E and 4F are perspective views and plan views for explaining a bending principle of the present invention. In this regard, the case where the first bending member 30A bends the cutting blade C rightward, will be supposed hereinbelow for easier understanding of the present invention. FIGS. 4A, 4B and 4C illustrate positions of the nozzle section 12, upper rotating part 20A of the first rotating body, upper rotating part 20B of the second rotating body, and first and second bending members 30A and 30B. FIGS. 4D, 4E and 4F illustrate relative positions of the first and second bending members 30A and 30B in respective bending steps for the cutting blade C. Concretely speaking, FIGS. 4A and 4D illustrate the bending standby position immediately before the cutting blade C is fed into the bending area, FIGS. 4B and 4E illustrate a bending start position in which a bending operation is started and the first bending member 30A is brought into contact with the cutting blade C, and FIGS. 4C and 4F illustrate a minimum acute angle forming position in which the first bending member 30A has maximally bent the cutting blade C to form a minimum acute angle.

While the lower rotating parts 21A and 21B of the first and second rotating bodies are not illustrated in FIGS. 4A, 4B and 4C, it is to be noted that they are configured in the same manner as the upper rotating parts 20A and 20B of the first and second rotating bodies, and the first and second bending members 30A and 30B extend toward the lower rotating parts 21A and 21B of the first and second rotating bodies to be rotated while being firmly supported thereby.

In FIGS. 4A and 4D, immediately before the bending operation is started, the first and second bending members 30A and 30B are maintained in the bending standby positions which are in the vicinity of a rear end of the nozzle section 12.

An upper end of the first bending member 30A is interference-fitted into the locking hole 210A defined in the upper rotating part 20A of the first rotating body, and a lower end of the first bending member 30A passes through the one end 230B of the curved guide slot 220B defined in the upper rotating part 20B of the second rotating body to be interference-fitted into the locking hole 211A defined in the lower rotating part 21A of the first rotating body. Then, as the cutting blade C is fed into the bending area, the upper rotating part 20A of the first rotating body is rotated in a direction indicated by an arrow in FIG. 4B. By this, the first bending member 30A is rotated along the curved guide slot 220B defined in the upper rotating part 20B of the second rotating body while being firmly supported by the upper rotating part 20A of the first rotating body, to be brought into contact with the cutting blade C. At this time, because force is not transmitted to the upper rotating part 20B of the second rotating body, the upper rotating part 20B of the second rotating body is fixedly maintained. Therefore, the second bending member 30B is maintained in the initial bending standby position as it is, until the bending operation for bending the cutting blade C rightward is completed. Then, in FIG. 4C illustrating a maximum rotation angle position of the first bending member 30A, the first bending member 30A is brought into contact with the other end 240B of the curved guide slot 220B defined in the upper rotating part 20B of the second rotating body to be interrupted in its rotation, whereby a minimum acute angle of the cutting blade C is formed. If the bending operation for bending the cutting blade C rightward is completed in this way, the upper rotating part 20A of the first rotating body is rotated in an adverse direction to allow the first bending member 30A to be returned to its bending standby position.

Thereupon, the cutting blade C is fed forward by a predetermined length. Then, in consideration of a final contour of the cutting blade C, when it is required to bend again the cutting blade C rightward, the first bending member 30A bends again the cutting blade C rightward in the same way as described above. In the meanwhile, if it is required to bend the cutting blade C leftward, force transmission to the upper and lower rotating parts 20A and 21A of the first rotating body is interrupted, and the upper and lower rotating parts 20B and 21B of the second rotating body are rotated in a direction which is reverse to the direction indicated by the arrow in FIG. 4B. By this, the second bending member 30B which is maintained in the bending standby position, is rotated to bend the cutting blade C leftward. In these ways, the first and second bending members 30A and 30B which are maintained in the bending standby positions, are alternately rotated to bend the cutting blade C rightward and leftward in conformity with the final contour of the cutting blade C, and thereby, bending of the cutting blade C is completed.

Because the bending system of the present invention is controlled by a computer, various data such as bending positions of the cutting blade C, bending directions, bending angles, rotation angles of the first and second rotating bodies, etc. are calculated beforehand in consideration of the final contour of the cutting blade C and stored in a memory. At this time, the bending operations are automatically performed by an execution program. Also, in the above example, for most cases in which a bending angle θ of the cutting blade C falls within an obtuse angle, the first bending member 30A is controlled in a manner such that the first bending member 30A is slightly rotated from the position shown in FIG. 4B in the direction indicated by the arrow to slight bend the cutting blade C rightward and then, is returned to its original position.

Also, as an another example, it is well contemplated that, at the under part of the working area, it is possible to closely place the lower rotating part 21A of the first rotating body below the lower rotating part 21B of the second rotating body.

Figure 5A:
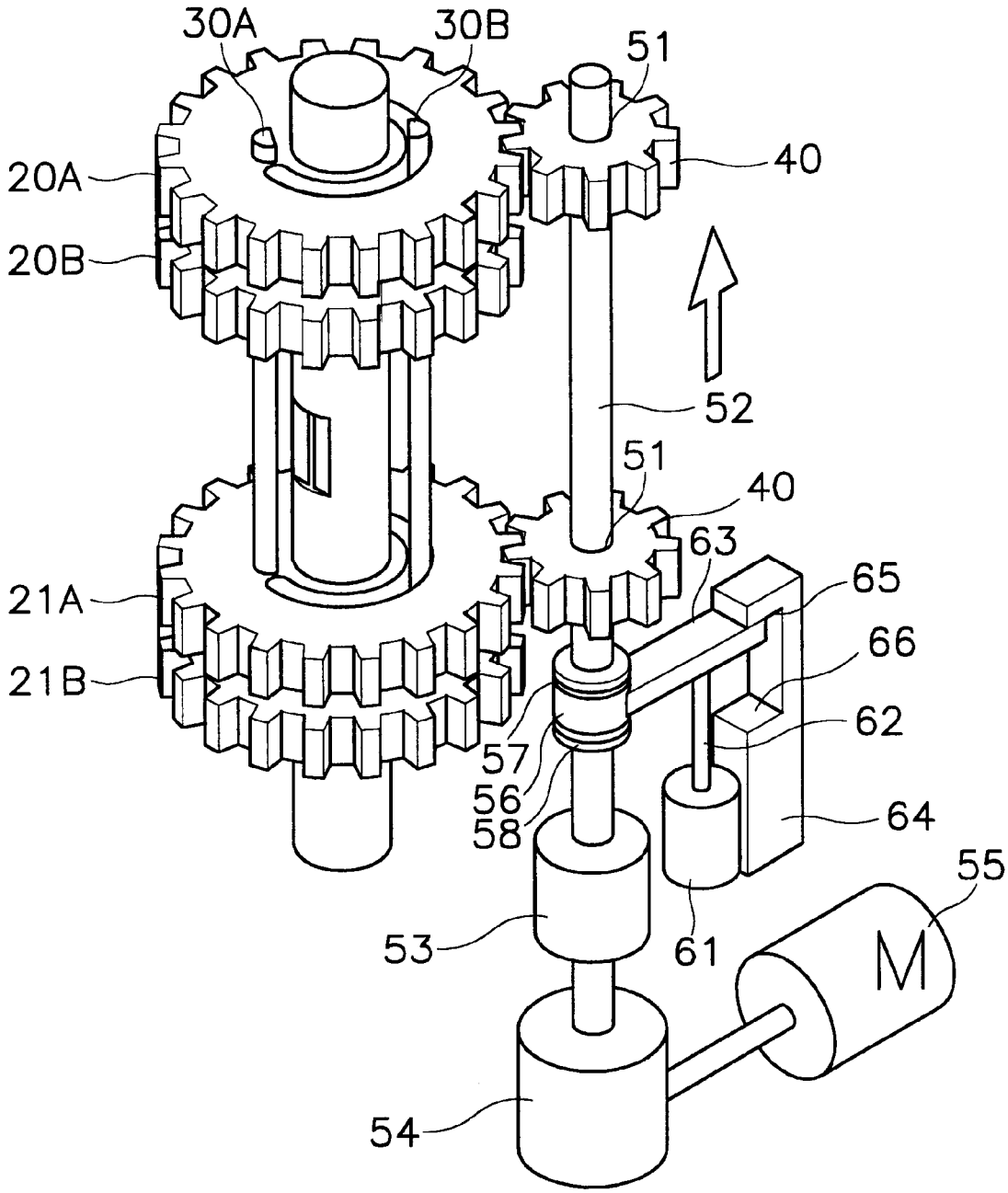
FIGS. 5*a* and 5*b* are perspective views illustrating an example of a driving body for driving the rotating bodies of the present invention.
Figure 5B:
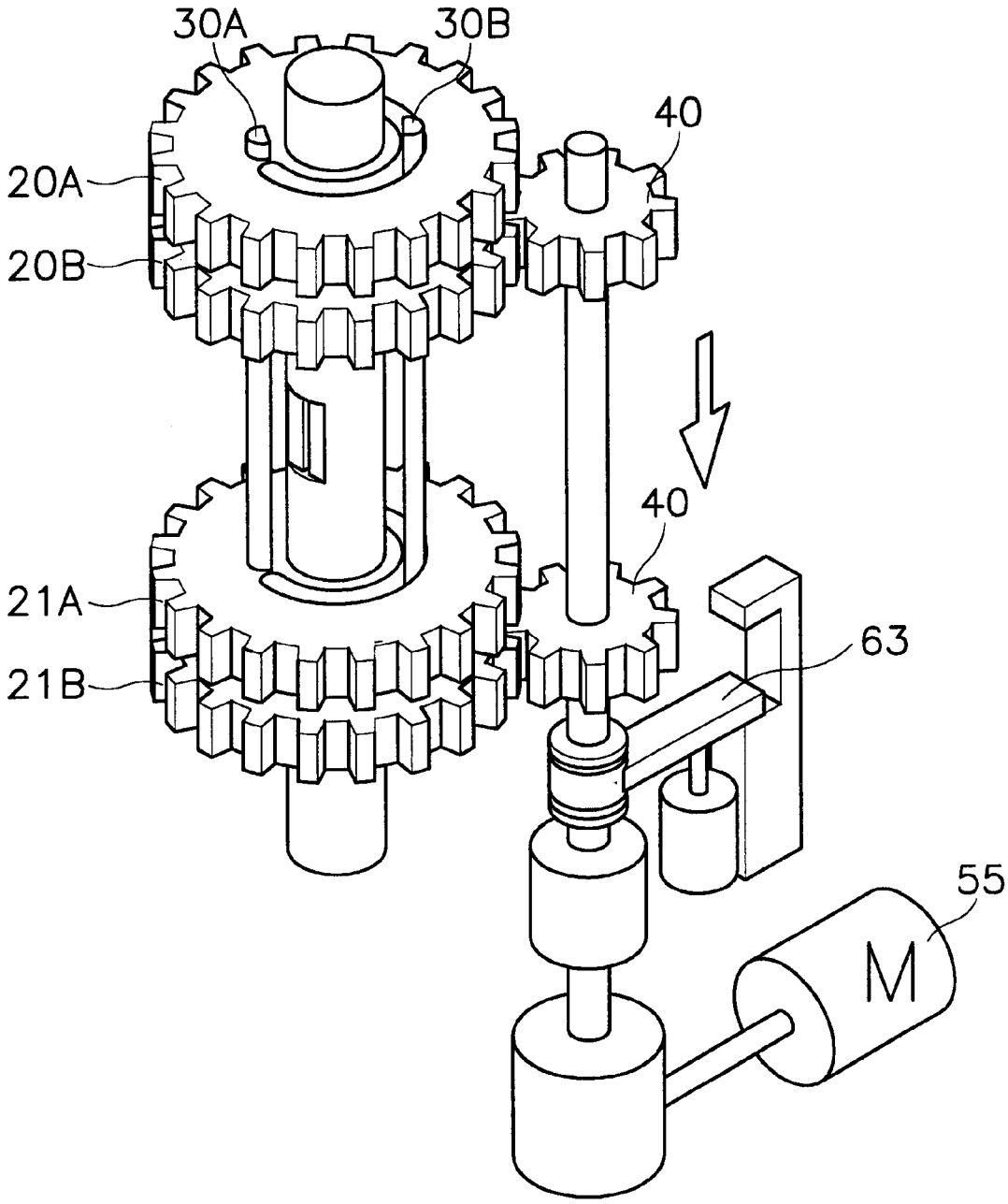

FIGS. 5*a* and 5*b* are perspective views illustrating an example of a driving body for independently driving the first and second rotating bodies of the present invention. In this connection, FIG. 5*a* illustrates a state wherein the upper and lower rotating parts 20A and 21A of the first rotating body are respectively meshed with driving parts 40 and 40 and thereby force is transmitted to the first rotating body, and FIG. 5*b* illustrates a state wherein the upper and lower rotating parts 20B and 21B of the second rotating body are respectively meshed with the driving parts 40 and 40 and thereby force is transmitted to the second rotating body. The respective rotating parts and the driving parts comprise gears, respectively, each of which serves as a driven and a driving gear.

As can be readily seen from FIGS. 5*a* and 5*b*, both ends of a driving shaft 52 are interference-fitted into center openings 51 which are respectively defined in the driving parts 40 and 40.

The driving shaft 52 is operatively connected to a pulse motor 55 via a first coupling 53 and a reducer 54. If the pulse motor 55 is operated, as the driving parts 40 and 40 are rotated, the first rotating body or the second rotating body is rotated. A lower end of the driving shaft 52 is supported inside the first coupling 53 so that the driving shaft 52 can be moved between a raised position as shown in FIG. 5*a* and a lowered position as shown in FIG. 5*b*. Adjacent to the lower driving part 40, a driving shaft moving mechanism is arranged on the driving shaft 52. The driving shaft moving mechanism is composed of a bearing and a second coupling 56 which surrounds the bearing and is defined on a circumferential outer surface thereof with a quadrangular locking groove. One end of a moving member 63 is locked into the locking groove. The moving member 63 is secured to a free end of a piston rod 62 of a pneumatic cylinder 61 to be moved in the vertical direction by actuation of the pneumatic cylinder 61. Further, a stopper bracket 64 functions to limit a vertical displacement of the moving member 63. A distance between a pair of horizontal surfaces 65 and 66 through which distance the movable member 63 can be moved in the vertical direction, substantially corresponds to a thickness of the upper or lower rotating part.

The drawing reference numerals 57 and 58 represent washers for preventing the driving shaft moving mechanism from being fluctuated or vibrated.

In the driving body constructed as mentioned above, as shown in FIG. 5*a*, when it is necessary to drive the upper and lower rotating parts 20A and 21A of the first rotating body, the moving member 63 is raised by actuation of the pneumatic cylinder 61, and the driving shaft moving mechanism which is coupled with the moving member 63 and the driving parts 40 and 40 are moved upward, whereby the driving parts 40 and 40 and the upper and lower rotating parts 20A and 21A of the first rotating body are meshed with each other. Thereafter, as the pulse motor 55 is driven, the driving parts 40 and 40 are rotated in a desired direction. By this, the upper and lower rotating parts 20A and 21A of the first rotating body are rotated, and the first bending member 30A which is locked to the upper and lower rotating parts 20A and 21A of the first rotating body, is rotated to bend the cutting blade C by a predetermined angle. At this time, since force is not transmitted to the upper and lower rotating parts 20B and 21B of the second rotating body, the first bending member 30A is stably rotated along the curved guide slots 220B and 221B defined in the upper and lower rotating parts 20B and 21B of the second rotating body. On the other hand, as shown in FIG. 5*b*, when it is necessary to drive the upper and lower rotating parts 20B and 21B of the second rotating body, reversely to the above-described sequence, the moving member 63 and the driving parts 40 and 40 are lowered so that the driving parts 40 and 40 are meshed with the upper and lower rotating parts 20B and 21B of the second rotating body. Then, by driving the pulse motor 55, the driving parts 40 and 40 and the upper and lower rotating parts 20B and 21B of the second rotating body are rotated.

While a force transmitting pattern by means of gear mesh was described in the above embodiment, it can be contemplated that the driving parts and the rotating bodies are provided with pulleys in such a way as to allow the first rotating body and the driving parts to be connected via belts and the second rotating body and the driving parts to be connected via belts. In the example as shown in FIGS. 5*a* and 5*b*, pulleys are respectively assigned to the upper and lower rotating parts of the first rotating body and the upper and lower rotating parts of the second rotating body, and two motors are independently driven to rotate the pulleys which are assigned to the driving parts.

Also, it is prefered to mount stoppers on the driving shaft so that non-rotating parts of the first or the second rotating body are fixed during the bending operation of the other rotating parts.

Figure 6:
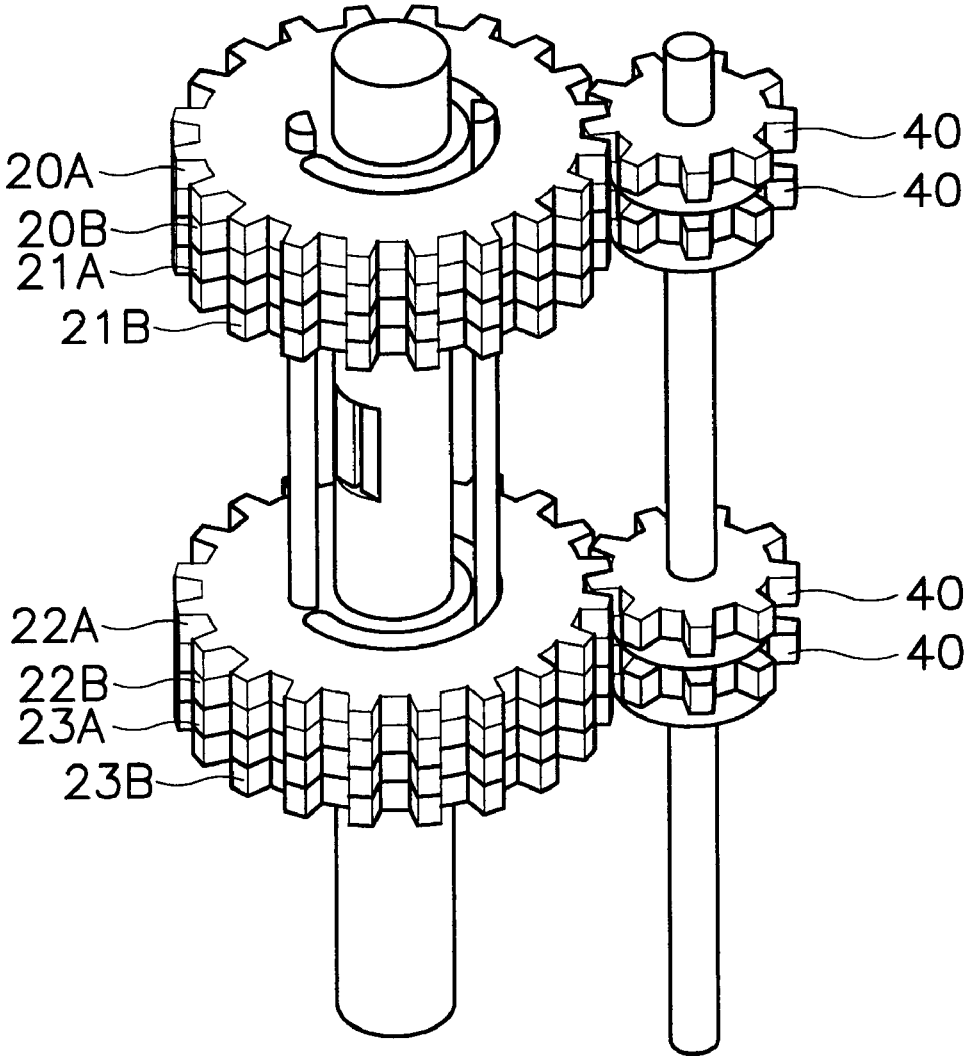
FIG. 6 is a perspective view illustrating rotating bodies each of which comprises a pair of upper rotating parts and a pair of lower rotating parts.
Figure 7A:
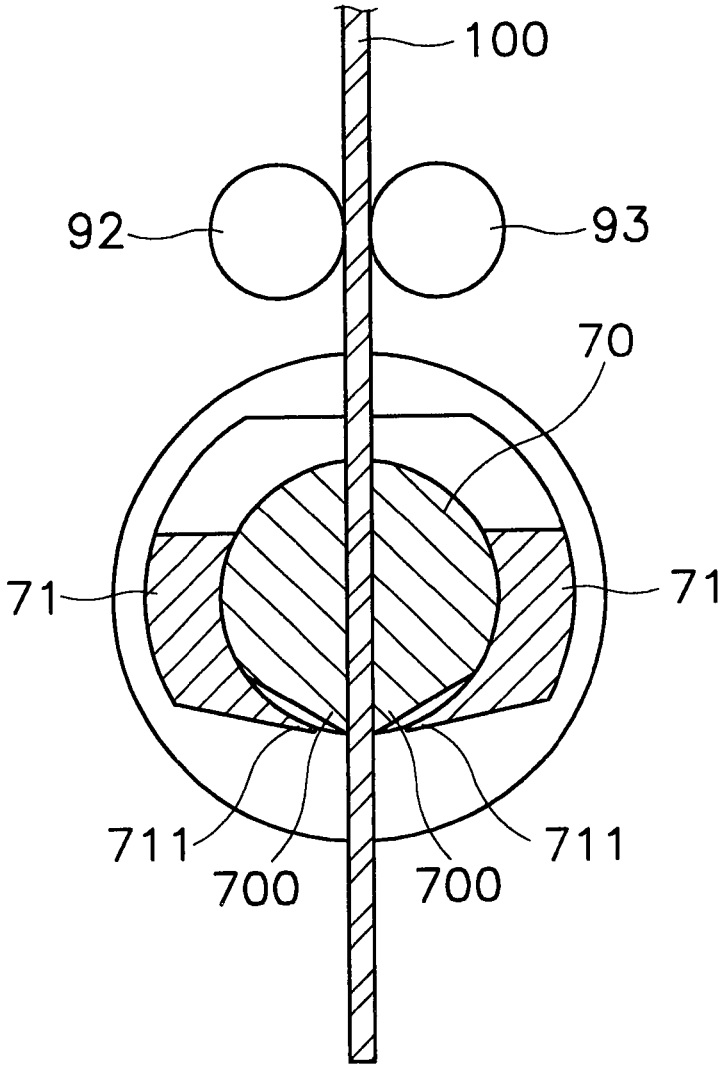
FIGS. 7*a* and 7*b* are transverse cross-sectional views for explaining technical concepts of conventional bending apparatuses.
Figure 7B:
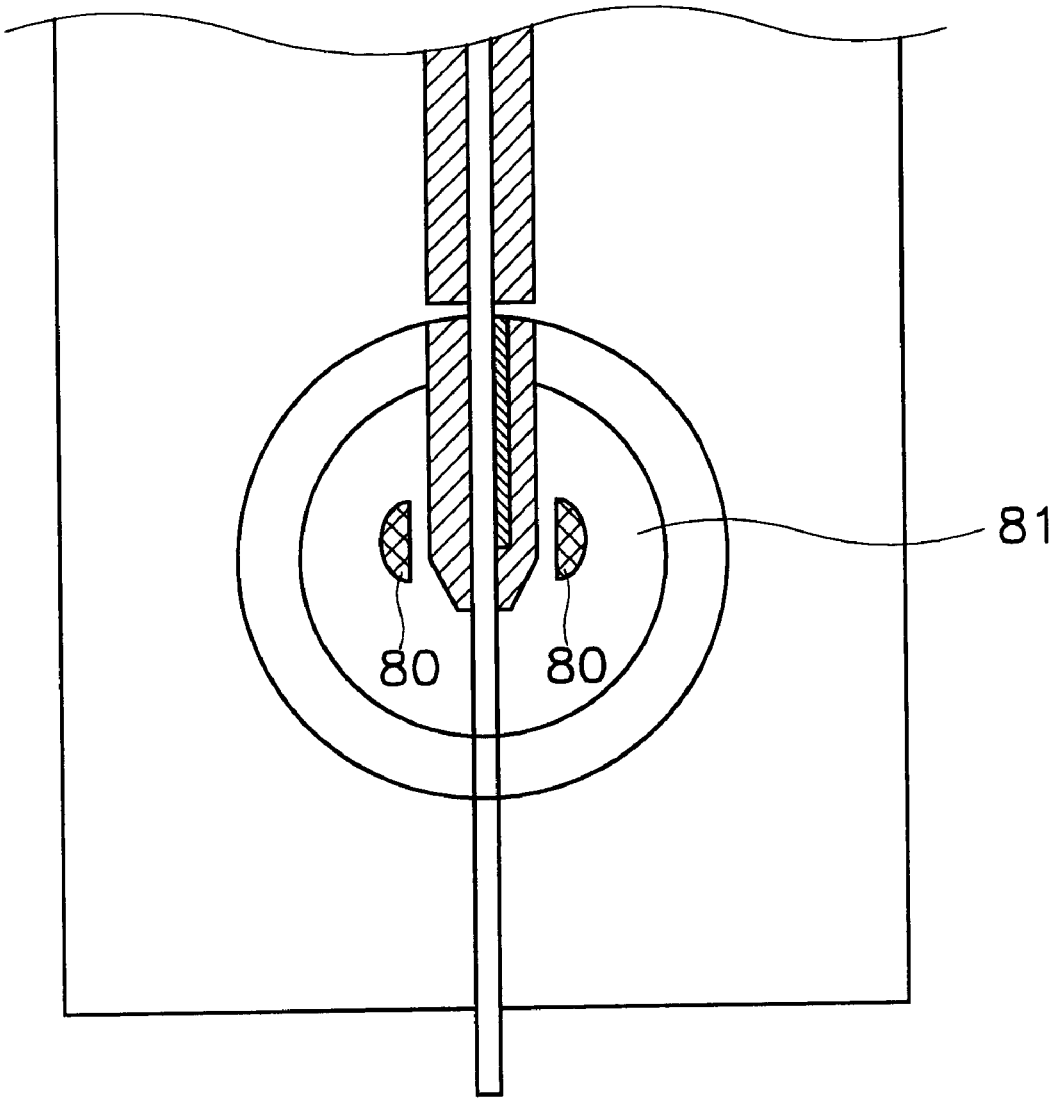

FIG. 6 is a perspective view illustrating an example in which a first rotating body comprises a pair of upper rotating parts 20A and 21A and a pair of lower rotating parts 22A and 23A and a second rotating body comprises a pair of upper rotating parts 20B and 21B and a pair of lower rotating parts 22B and 23B. In this example, in the case of upper rotating parts, a first upper rotating part 20A of the first rotating body, a first upper rotating part 20B of the second rotating body, a second upper rotating part 21A of the first rotating body and a second upper rotating part 21B of the second rotating body are sequentially arranged in a downward direction. It is to be readily understood that lower rotating parts are also arranged in the same manner as the upper rotating parts. A driving section is composed of four gears 40, 40, 40 and 40 which are respectively meshed with the rotating parts which constitute the first rotating body or the second rotating body. In this example, because first and second bending members bend a cutting blade while being supported by four rotating parts, more precise and stable bending of the cutting blade can be ensured.

As a result, the cutting blade bending apparatus according to the present invention provides advantages in that, since rotation of first and second bending members is independently implemented, interference is not caused between the first and second bending members, and thereby, a cutting blade can be bent in such a way as to form a wide range of acute angle.

Also, due to the fact that one bending member is supported by its rotating body and is rotated between one end of a curved guide slot defined in the other rotating body which one end corresponds to a bending standby position and the other end of the curved guide slot defined in the other rotating body which the other end corresponds to a maximum bending position, it is possible to precisely form an acute angle, and the maximum bending position can be established within a wide range of acute angle.

Further, because both ends of each bending member are respectively interference-fitted into locking holes which are defined in the rotating body, it is possible to apply strong biasing force to the cutting blade upon actually bending the cutting blade, and thereby, increased horizontal and vertical bending accuracies for the cutting blade can be accomplished. Moreover, because vertical movement of the bending member as is the case with the conventional art, is unnecessary, preciseness and efficiency can be elevated upon performing a bending operation, and durability of the apparatus can be improved.

Furthermore, by the fact that each of first and second rotating bodies comprises at least one pair of upper and lower rotating parts, and rotating parts of the first and second rotating bodies are alternately arranged one with another, since each bending member is rotated while being supported by its upper and lower rotating parts, stronger and uniform biasing force can be applied to the cutting blade, and thereby, precise vertical and horizontal bending of the cutting blade can be facilitated.

In the drawings and specification, there have been disclosed typical preferred embodiments of the invention and, although specific terms are employed, they are used in a generic and descriptive sense only and not for purposes of limitation, the scope of the invention being set forth in the following claims.

I claim:

1. A cutting blade bending apparatus comprising:

a nozzle section for feeding a cutting blade into a bending area through a guide opening which is defined therein in a lengthwise direction of the cutting blade;

a first bending member for bending the cutting blade fed into the bending area, in one direction;

a second bending member for bending the cutting blade fed into the bending area, in the other direction;

a first rotating body having at least a locking hole for firmly supporting the first bending member and a guide slot for guiding rotation of the second bending member;

a second rotating body having at least a locking hole for firmly supporting the second bending member and a guide slot for guiding rotation of the first bending member, the second rotating body being rotated independent of the first rotating body; and a driving section for rotatably driving, at a time, one of the first and second rotating bodies.

2. The apparatus as claimed in claim 1, wherein the nozzle section and the first and second rotating bodies are coaxially arranged one with another in a vertical direction, and the nozzle section passes through center portions of the first and second rotating bodies;

wherein the first rotating body comprises at least one pair of upper and lower rotating parts which are opposite to each other in the vertical direction with the guide opening of the nozzle section positioned between the upper and lower rotating parts and which are respectively defined with locking holes for firmly locking both ends of the first bending member and curved guide slots for guiding rotation of the second bending member;

and wherein the second rotating body comprises at least one pair of upper and lower rotating parts which are opposite to each other in the vertical direction with the guide opening of the nozzle section positioned between the upper and lower rotating parts and which are respectively defined with locking holes for firmly locking both ends of the second bending member and curved guide slots for guiding rotation of the first bending member.

3. The apparatus as claimed in claim 2, wherein each of the curved guide slots which are defined in the upper and lower rotating parts of the first rotating body, has one end corresponding to a bending standby position of the second bending member and the other end corresponding to a maximum bending position of the second bending member; and wherein each of the curved guide slots which are defined in the upper and lower rotating parts of the second rotating body, has one end corresponding to a bending standby position of the first bending member and the other end corresponding to a maximum bending position of the first bending member.

4. The apparatus as claimed in claim 2, wherein each of the first and second rotating bodies comprises at least two pairs of upper and lower rotating parts; wherein upper rotating parts of the first and second rotating bodies are coaxially and alternatively arranged one with another above the guide opening of the nozzle section; and wherein lower rotating parts of the first and second rotating bodies are coaxially and alternately arranged one with another below the guide opening of the nozzle section.

5. The apparatus as claimed in claim 2, wherein the driving section for rotatably driving the first and second rotating bodies comprises at least two gears, and, by vertical movement of the at least two gears, driving force is independently transmitted to the first and second rotating bodies.

6. The apparatus as claimed in claim 3, wherein each of the first and second rotating bodies comprises at least two pairs of upper and lower rotating parts; wherein upper rotating parts of the first and second rotating bodies are coaxially and alternatively arranged one with another above the guide opening of the nozzle section; and wherein lower rotating parts of the first and second rotating bodies are coaxially and alternately arranged one with another below he guide opening of the nozzle section.

7. The apparatus as claimed in claim 1, wherein the driving section for rotatably driving the first and second rotating bodies comprises at least two gears, and, by vertical movement of the at least two gears, driving force is independently transmitted to the first and second rotating bodies.

8. A cutting blade bending apparatus comprising:

a nozzle section for feeding a cutting blade into a bending area through a guide opening which is defined therein in a lengthwise direction of the cutting blade;

at least one pair of first rotating parts located up and down with the guide opening of the nozzle section positioned therebetween, for bending the cutting blade fed into the bending area, in one direction;

a first bending member capable of being rotated while being supported by the at least one pair of first rotating parts;

at least one pair of second rotating parts located up and down with the guide opening of the nozzle section positioned therebetween, for bending the cutting blade fed into the bending area, in the other direction, the first and second rotating parts being coaxially and alternately arranged one with another;

a second bending member capable of being rotated while being supported by the at least one pair of second rotating parts; and a driving section for rotatably driving, at a time, the first rotating parts or the second rotating parts.

9. The apparatus as claimed in claim 6, wherein the first rotating parts for rotating the first bending member respectively include curved guide slots for guiding rotation of the second bending member, and the second rotating parts for rotating the second bending member respectively include curved guide slots for guiding rotation of the first bending member.

10. A cutting blade bending apparatus comprising:

(A) a first upper rotating body comprising a locking hole positioned eccentrically from the center part thereof, and a guide slot extending from the position adjacently located to the locking hole to generally form a lengthy and circularly curved slot;

(B) a second upper rotating body located closely to the first upper rotating body, and comprising a locking hole formed at a position corresponding to an end of the guide slot of the first upper rotating body, and a guide slot extending from the position adjacently located to the locking hole to the position corresponding to the locking hole of the first upper rotating body to also generally form a lengthy and circularly curved slot;

(C) a first lower rotating body identical to the first upper rotating body (A) and separated therefrom by a predetermined distance longer than the height of the cutting blade, the first lower rotating body positioned concentrically with the first upper rotating body;

(D) a second lower rotating body identical to the second upper rotating body (B) and separated therefrom by the above predetermined distance, the second lower rotating body positioned concentrically with the second upper rotating body;

(E) a first bending member firmly locked by the locking holes of the first upper and lower rotating bodies, and at the same time rotatably guided by the guide slots of the second upper and lower rotating bodies; and (F) a second bending member firmly locked by the locking holes of the second upper and lower rotating bodies, and at the same time rotatably guided by the guide slots of the first upper and lower rotating bodies.

11. The apparatus as claimed in claim 8, wherein the apparatus further comprises a cylindrical nozzle section that passes through the center parts of the first and the second rotating bodies and has a guide opening at the axial center part thereof for guiding the cutting blade into a bending area.

12. A cutting blade bending apparatus comprising:

(A) a first upper rotating body comprising a locking hole positioned eccentrically from the center part thereof, and a guide slot extending from the position adjacently located to the locking hole to generally form a lengthy and circularly curved slot;

(B) a second upper rotating body located closely to the first upper rotating body, and comprising a locking hole formed at a position corresponding to an end of the guide slot of the first upper rotating body, and a guide slot extending from the position adjacently located to the locking hole to the position corresponding to the locking hole of the first upper rotating body to also generally form a lengthy and circularly curved slot;

(C) a second lower rotating body identical to the second upper rotating body (B) and separated therefrom by a predetermined distance longer than the height of the cutting blade, the second lower rotating body positioned concentrically with the second upper rotating body;

(D) a first lower rotating body identical to the first upper rotating body (A) and closely located below to the second lower rotating body, the first lower rotating body positioned concentrically with the first upper rotating body;

(E) a first bending member firmly locked by the locking holes of the first upper and lower rotating bodies, and at the same time rotatably guided by the guide slots of the second upper and lower rotating bodies; and (F) a second bending member firmly locked by the locking boles of the second upper and lower rotating bodies, and at the same time rotatably guided by the guide slots of the first upper and lower rotating bodies.

13. The apparatus as claimed in claim 12, wherein the apparatus further comprises a cylindrical nozzle section that passes through the center parts of the first and the second rotating bodies and has a guide opening at the axial center part thereof for guiding the cutting blade into a bending area.

* * * * *